US006555954B1

(12) United States Patent
Chandler et al.

(10) Patent No.: US 6,555,954 B1
(45) Date of Patent: Apr. 29, 2003

(54) COMPACT ELECTRODELESS FLUORESCENT LAMP WITH IMPROVED COOLING

(75) Inventors: Robert Chandler, Lexington, MA (US); Edward K. Shapiro, Lexington, MA (US); Oleg A. Popov, Needham, MA (US); Jakob Maya, Brookline, MA (US)

(73) Assignees: Matsushita Electric Industrial Co., Ltd., Osaka (JP); Matsushita Electric Works, Ltd., Osaka (JP)

( * ) Notice: Subject to any disclaimer, the term of this patent is extended or adjusted under 35 U.S.C. 154(b) by 208 days.

(21) Appl. No.: 09/616,167

(22) Filed: Jul. 14, 2000

(51) Int. Cl.[7] ..... H01J 1/62

(52) U.S. Cl. ..... 313/485; 313/46; 313/161; 315/248

(58) Field of Search ..... 313/45, 46, 27, 313/47, 160, 161, 485; 315/248, 344

(56) References Cited

U.S. PATENT DOCUMENTS 4,298,828 A * 11/1981 Justice et al. ..... 315/248
4,536,675 A * 8/1985 Postma ..... 313/46
4,661,746 A * 4/1987 Postma et al. ..... 315/248
5,355,054 A * 10/1994 Van Lierop et al. ..... 315/112
5,572,083 A * 11/1996 Antonis et al. ..... 313/46
5,804,911 A * 9/1998 Van Gennip et al. ... 313/318.01
5,811,914 A * 9/1998 Eijkens ..... 313/51
5,852,339 A * 12/1998 Hamilton et al. ..... 313/11
6,081,070 A * 6/2000 Popov et al. ..... 313/46
6,433,478 B1 * 8/2002 Chandler et al. ..... 313/234
2001/0000941 A1 * 5/2001 Chandler et al. ..... 313/46

* cited by examiner

*Primary Examiner*—Ashok Patel
*Assistant Examiner*—Glenn Zimmerman
(74) *Attorney, Agent, or Firm*—Kinney & Lange, P.A.

(57) ABSTRACT

The present invention comprises a compact electrodeless fluorescent lamp that includes a transparent envelope containing a fill of inert gas along with a vaporizable metal such as mercury. An induction coil is operated by a driver circuit, and is positioned inside of a reentrant cavity in the envelope with an adjacent permeable magnetic field manipulation structure having a shunting surface ending at a shunting surface periphery. A thermally and electrically conductive primary cooling structure is positioned adjacent the magnetic field manipulation structure to extend within the shunting surface periphery while being separated from the induction coil thereby. A further component cooling structure is provided to at least partially enclose the driver circuit connected to the induction coil.

2 Claims, 6 Drawing Sheets

COMPACT ELECTRODELESS FLUORESCENT LAMP WITH IMPROVED COOLING

BACKGROUND OF THE INVENTION

The present invention relates to electric lamps, more specifically, to compact electrodeless fluorescent lamps operated at low and intermediate pressures and at frequencies above 20 kHz.

Electrodeless compact fluorescent lamps (ECFL) have been recently made available for indoor lighting. The advantage of such lamps is their long operating lifetime which is much longer than that of conventional compact fluorescent lamps employing heating filaments. The visible light is generated by an inductively coupled plasma that, in turn, is produced by a RF electromagnetic field generated in the lamp bulb by an induction coil.

A known compact electrodeless fluorescent lamp "Genura" (General Electric Corp.) is operated at a RF frequency of 2.65 MHz and utilizes an induction coil with a ferrite core inserted in a reentrant cavity formed in a transparent bulb container. Genura is marketed as a replacement for an R30 incandescent lamp and is indicated to have 1,100 lumen light output at 23 W of RF power with an operating lifetime of 15,000 hrs. The drawback of the Genura lamp is its high initial cost, and relatively large diameter (80 mm) that is larger than that of a 100-W incandescent lamp (60 mm) having 1500 lumen light output. The latter characteristic imposes some restrictions on the conditions of lamp usage. In addition, the lamp employs an internal reflector and so can be used only in recessed lamp holding fixtures for downward lighting applications.

The high initial cost of the Genura lamp is due to the high cost of the driver electronic circuitry because of being operated at a frequency of 2.65 MHz, and which must include a special circuit to prevent electromagnetic interference (EMI). Thus, the use of a lower frequency of approximately 100 kHz is desired to reduce the initial lamp cost.

Also, a compact electrodeless fluorescent lamp is desired that is smaller than the Genura lamp (i.e. made with a 60 mm diameter equivalent to that of a A25 bulb) and that can be used in regular fixtures for both upward lighting and downward lighting applications.

In a copending U.S. Patent Application entitled "High Frequency Electrodeless Compact Fluorescent Lamp" having Ser. No. 09/435,960 by Chandler et al. and assigned to the same assignee as the present invention, a compact electrodeless fluorescent lamp is disclosed that is operated at relatively "low" frequencies from 50 kHz to 500 kHz. The lamp utilizes a ferrite core and a thin ferrite disk attached to the core bottom both made from MnZn material. A multiple insulated strand wire (Litz wire) is used for the induction coil that is wound in two layers around the ferrite core.

Two types of cooling structures that remove the heat generated during operation from the cavity and the ferrite core are described in that application. The first structure comprises a copper tube inside the ferrite core that protrudes along the lamp base down to the Edison socket cup and is welded to a copper cylinder in the Edison socket cup. Such an arrangement provides for the transmission of heat from the cavity/ferrite core to the Edison socket cup and then to the lamp holding fixture. However, this approach has two disadvantages. In many applications, the Edison socket cup does not have a good thermal contact with the fixture, and thus the resulting relatively poor thermal conduction leads to an increase of the ferrite core material operating temperature to values higher than its Curie point. The second disadvantage is the position of the metal (or ceramic) cooling tube in the base center, along its axis, that makes it difficult to place the driver electronic circuitry inside the base.

The other structure taught in this application comprises a metal tube inside the ferrite core and a ceramic structure that is thermally connected to the tube. The ceramic structure has a shape of a "skirt" and transfers the heat from the cavity and the core to the atmosphere via convection.

Both of these types of cooling structures provide acceptable ferrite core temperatures during operation, that is, temperatures lower than the ferrite material Curie point of 220° C., and sufficiently low temperature inside the lamp base (<100° C.), when the lamp is operated without a lamp holding fixture at an ambient temperature of 25° C. However, neither of these arrangements may always provide the desired operating temperatures when the lamp is inserted in a lamp holding fixture that has the effect of increasing the effective lamp "ambient" temperature up to 50–60° C. Therefore, a more efficient cooling structure is desired for reliable operation of such lamps in a holding fixture.

Also, the use of ceramic (alumina) material structure is rather costly so that the initial cost of the lamp may be unacceptably high. The use of materials less expensive than alumina but with the same (or higher) thermal conductivity is desirable to reduce the initial cost of the lamp cooling structure and, hence, of the whole lamp system.

SUMMARY OF THE INVENTION

The present invention comprises a compact electrodeless fluorescent lamp that includes a transparent envelope containing a fill of inert gas along with a vaporizable metal such as mercury. An induction coil, such as one formed by Litz wire, is operated by a driver circuit, and is positioned inside of a reentrant cavity in the envelope with an adjacent permeable magnetic field manipulation structure having a shunting surface ending at a shunting surface periphery. The magnetic field manipulation structure may comprise a toroid with a disk-like base, and may be formed of a ferrite material. A thermally and electrically conductive primary cooling structure is positioned adjacent the magnetic field manipulation structure to extend within the shunting surface periphery while being separated from the induction coil thereby. The primary cooling structure may comprise a thermally conductive tube, such as a metal tube, for instance copper, placed inside of the cavity extending so as to extend with in the toroid, and may have a finned dissipater provided therewith.

A further component cooling structure is provided to at least partially enclose the driver circuit connected to the induction coil. This component cooling structure is separate from the primary cooling structure, and may cool at least an electrolytic capacitor in the driver circuit.

DESCRIPTION OF THE PREFERRED EMBODIMENTS

Figure 1:
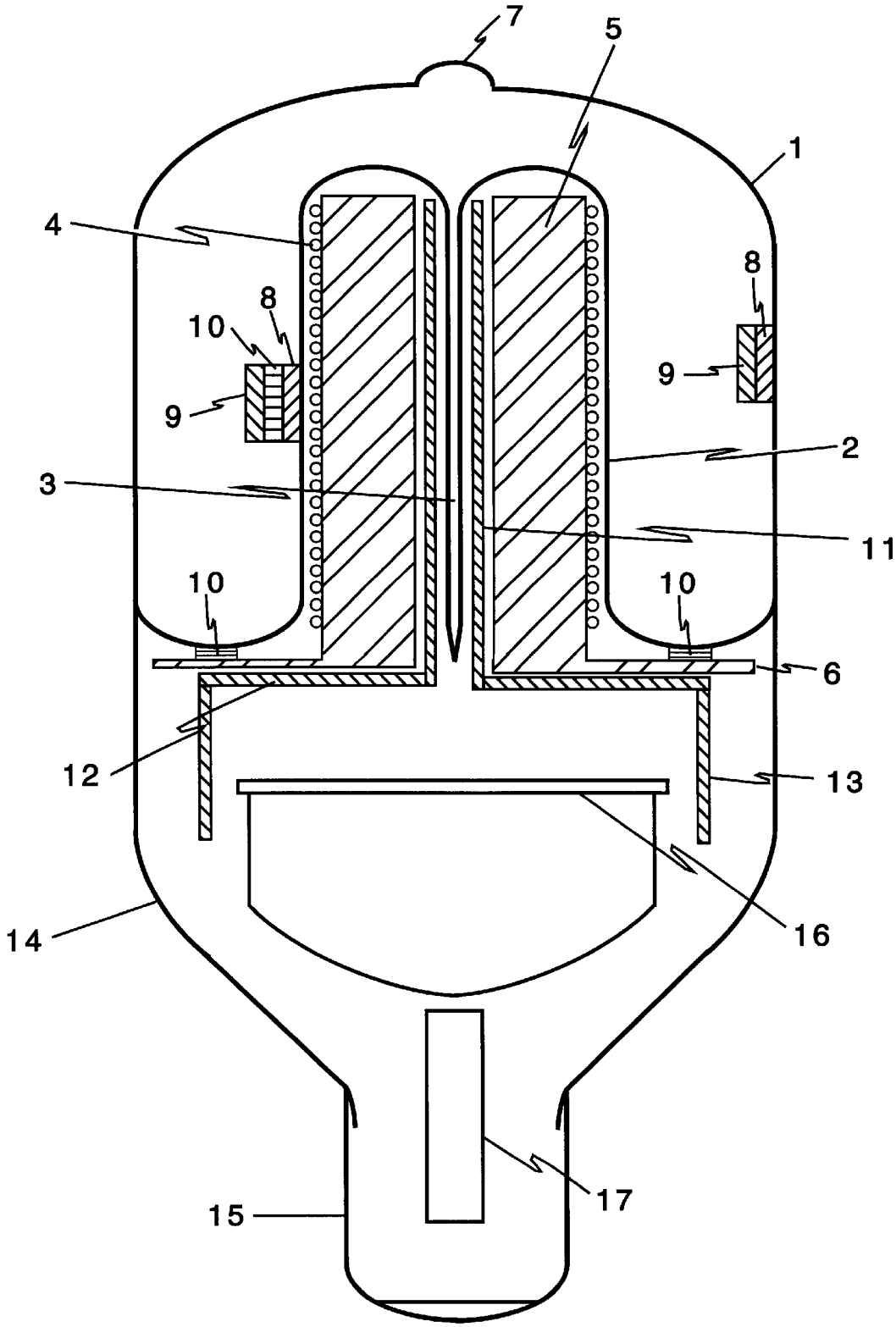
FIG. 1 is a schematic cross-sectional view of an embodiment of the present invention showing an electrodeless compact fluorescent lamp having a ferrite operations structure and a cooling structure for the ferrite operations structure.

Referring to the cross-section view of the lamp of the present invention in FIG. 1, a transparent bulbous envelope 1 made from glass has a reentrant cavity 2 with an exhaust tubulation 3 located inside the cavity 2 on its axis of substantially radial symmetry. An induction coil 4 made from multiple insulated strand wire (Litz wire) is coiled (two layers) around a permeable, electrically insulative, ferrite material core 5 of a toroidal shape. Litz wire can have from 40 to 150 strands each of gage # 40, and the number of turns is from 40 to 80. In preferred embodiments the number of strands is 60 and the number of turns is 65. The maximum temperature that typically this wire can withstand is 200° C.

Ferrite material core 5 is made from manganese zinc, MnZn, material and is positioned within reentrant cavity 2. The Curie point of this ferrite material is typically 220° C. The core outer diameter is typically about 15 mm and the height is typically about 55 mm. A thin ferrite disk 6 with a central opening is also typically made from MnZn material, though a different ferrite material can be used, and is firmly positioned against the ferrite material core 5 to provide an essentially continuous magnetically permeable material path, or they are together formed as a single unitary ferrite material structure. In preferred embodiments, the diameter of disk 6 is typically about 50 mm, and its thickness is typically about 1.0 mm. Ferrite disk 6 concentrates and orients magnetic fields generated in coil 4 and core 5 during operation so as to in effect shape these magnetic fields to be shunted, or to occur, away from a cooling structure made of copper positioned below it to be further described in the following. Such a result thereby decreases power losses in the cooling structure due to eddy currents and so increases the quality factor, or Q-factor, of the coil/ferrite assembly at resonance during operation.

The inert gas (argon, krypton, or the like) fill is at a pressure ranging from 0.1 torr to 5 torr. The mercury vapor pressure (approximately 6 mtorr) is controlled by the temperature of the mercury drop positioned in the cold spot that is located on the inner surface of protrusion 7 of envelope 1 at the top thereof. The inner walls of envelope 1 and cavity 2 are coated with protective coating (alumina or the like) 8 and a phosphor coating 9 represented only in part and in schematic form in FIG. 1. The inner walls of cavity 2 are further coated with a reflective coating 10, which is also a single coating provided on the outer walls at the bottom of envelope 1.

A cooling assembly in the embodiment of FIG. 1 is typically made from copper and comprises three parts welded to each other: a tube 11 positioned in the interior opening of ferrite core 5, a plate 12 with a central opening admitting tube 11, and a skirting liner 13 at the outer periphery of plate 12. In this embodiment, the diameter of plate 12 is typically about 50 mm, and its thickness is typically about 2 mm. The interior openings of core 5 and disk 6 are similar in size and are both large enough to accommodate tube 11 therethrough. This cooling structure could be made from an alternative thermally conductive material such as aluminum.

Liner 13 can be a right cylindrical shell or a somewhat conical shell. In the preferred embodiments, liner 13 is a right cylindrical shell that typically has about a 45 mm outer diameter, and typically about a 15 mm length. Note that the outer diameters of copper plate 12 and copper liner 13 are smaller than the outer diameter, or periphery, of ferrite disk 6 leaving a peripheral region along the outer edge of disk 6 not reached by copper plate 12 and copper liner 13. As a result, magnetic fields generated by coil 4 and the ferrite core/disk assembly during operation which penetrate copper parts 12 and 13 to cause eddy currents therein, and hence, power losses, in those copper parts, are much reduced to thereby increase the coil/ferrite/copper structures Q-factor and increase the lamp power efficiency. The wall thickness of liner 13 can typically be about from 0.2 mm to 5 mm. In the preferred embodiments, the thickness of the liner's walls is 1.5 mm.

A plastic material enclosure 14 forms the lamp base and is connected with the bottom of envelope 1 and Edison socket cup15. A printed circuit (PC) board 16 with the driver electronic circuitry and the impedance matching network thereon is positioned inside enclosure 14. In this embodiment, copper plate 12 and copper liner 13 are inside of plastic enclosure 14. The mains, or main electrical power interconnections in the lamp base, are supplied with standard alternating current from a standard alternating voltage through the lamp holding fixture holding the lamp during usage via the Edison socket cup 15, and they extend from socket cup 15 to be connected to the driver electronic circuitry located on PC board 16.

Figure 2:
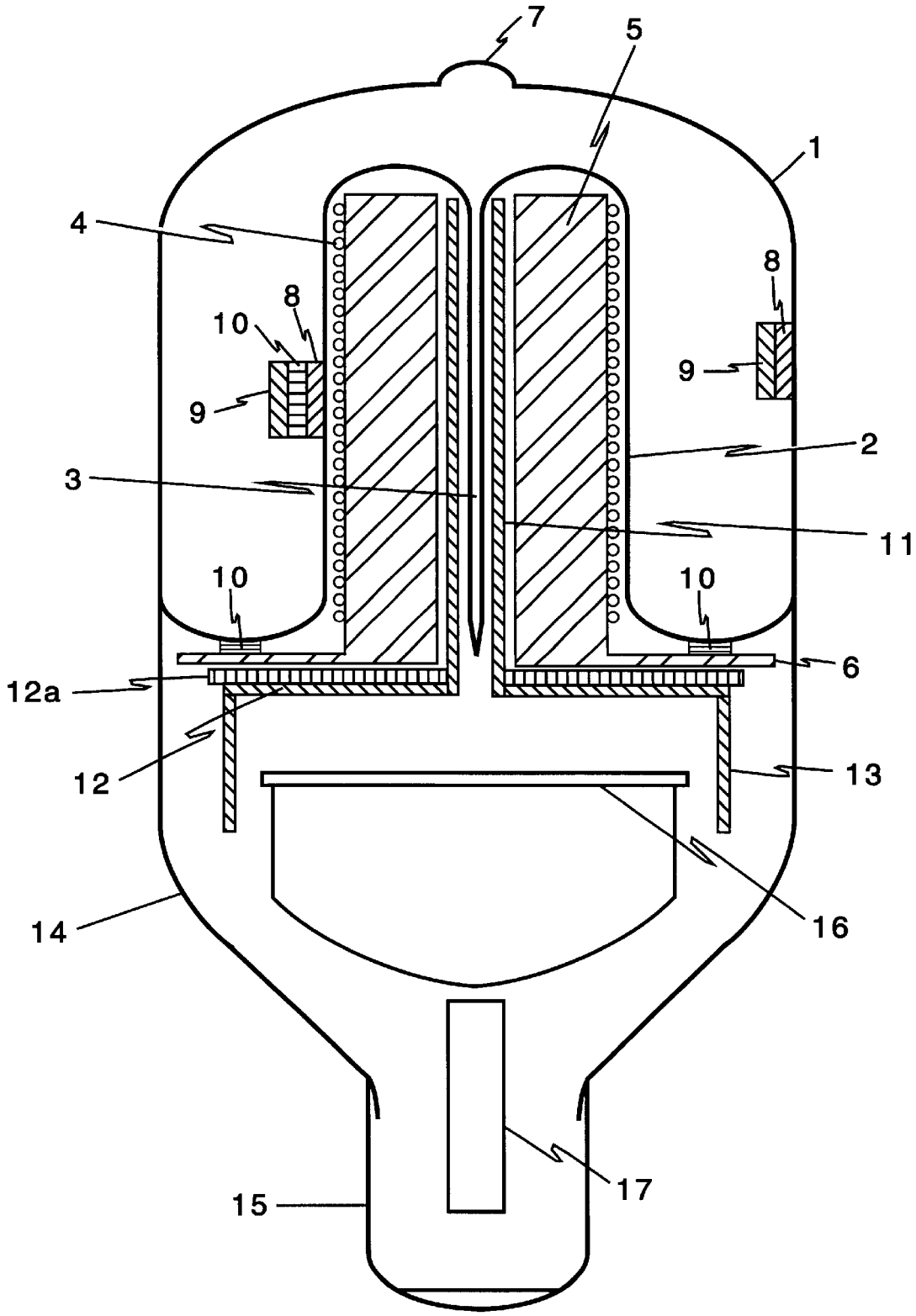
FIG. 2 is the schematic cross-sectional view of another embodiment of the present invention showing an electrodeless compact fluorescent lamp having a ferrite operations structure and an enhanced cooling structure for the ferrite operations structure.

Another embodiment of the present lamp invention is shown in cross section in FIG. 2. Bulbous envelope 1, cavity 2, coil 4, ferrite material core 5, and ferrite material disk 6 are the same as shown in FIG. 1. The cooling structure in this embodiment, again made of copper, comprises tube 11, plate 12, liner 13, and a further disk-like dissipater 12*a* with a central opening at which it is welded to tube 11, and also welded at its lower disk surface to plate 12. Dissipater 12*a* has fins which help to cool the foregoing copper structure through convection or conduction, or both, and hence, ferrite material core 5.

The heat absorbed by ferrite material core 5 during operation is removed by copper tube 11 and conductively transferred to plate 12 and dissipator 12*a*. A fraction of this heat is dissipated by dissipater 12*a*, and the rest is redirected to liner 13 where it is dissipated in the ambient atmosphere via convection. As a result, the operating temperatures of ferrite core 5 and PC board 16, where the driver circuitry components are located, are kept substantially lower by the presence of this cooling structure than they would be in its absence.

The two embodiments described above provide a relatively low (below the Curie point) operating temperature for ferrite material core 5. However, the arrangements shown in FIGS. 1 and 2 are not sufficient to reduce the temperature of the circuit component of the driver circuitry that is most sensitive to high temperature, an electrolytic capacitor 17. Indeed, a portion of the heat transferred to ferrite disk 6 and liner 13 reaches PC board 16 and, hence, reach the components of the driver circuitry including capacitor 17. To reduce the temperature of capacitor 17, two further arrangements are provided to lower the operating temperature (below 120° C.) of capacitor 17.

Figure 3:
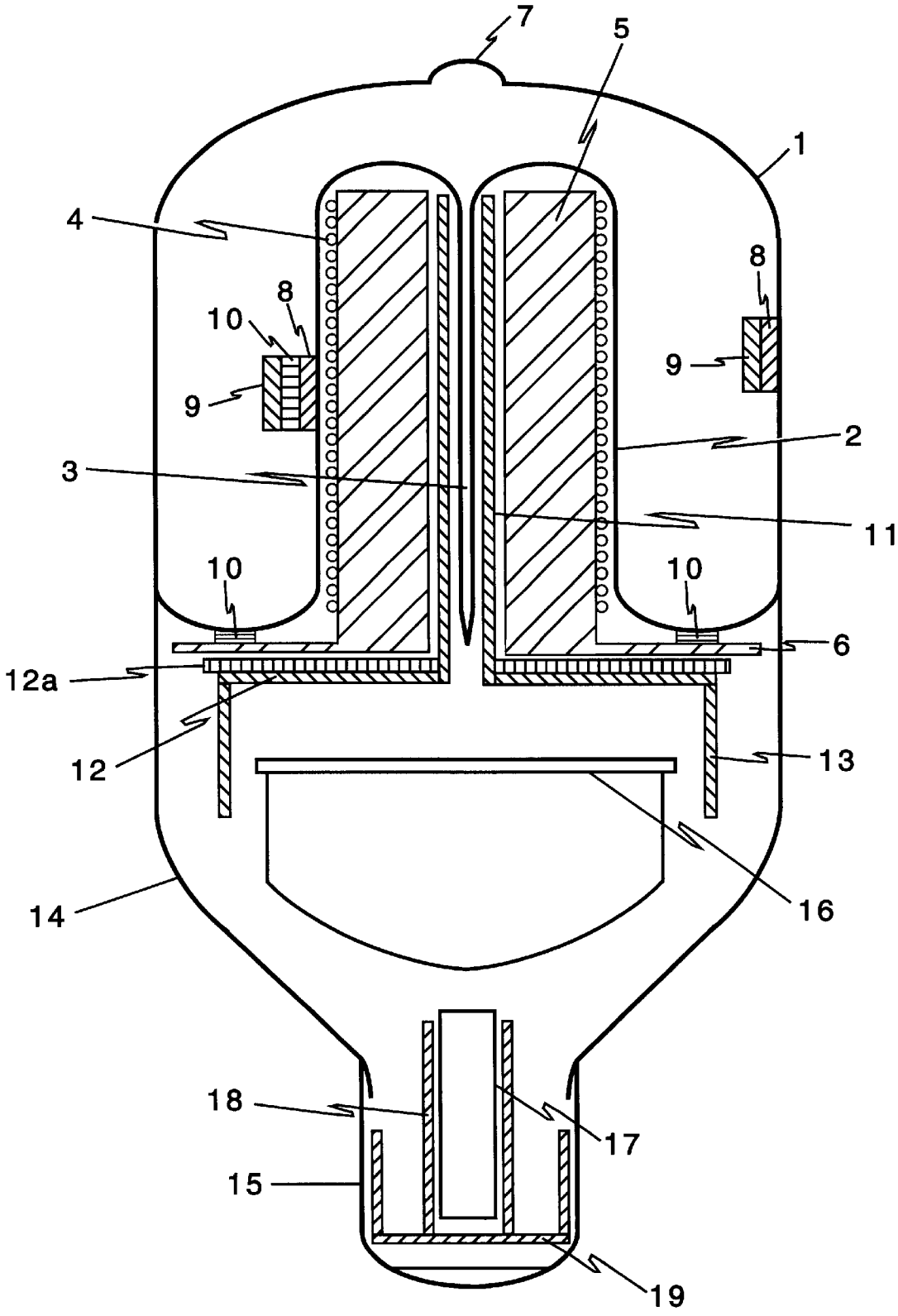
FIG. 3 is the schematic cross-sectional view of another embodiment of the present invention showing a lamp having a ferrite operations structure and a cooling structure for the ferrite operations structure, and having a further cooling structure for a driver circuit.

Thus, a further embodiment of the present invention is shown in the cross-section view of FIG. 3. A heat sink 18 made of copper is positioned in lamp base 14 and substantially encloses electrolytic capacitor 17. Heat sink 18 is shaped as a cylindrical shell and its inner diameter is slightly larger than the parallel extent of capacitor 17. Electrical insulating material, not shown, having good thermal conductivity (e.g. impregnated Teflon) electrically insulates heat sink 18 from capacitor 17 thereby providing conductive heat removal from the capacitor 17 without allowing sink 18 to electrically interfere with, or permit damage to, the driver circuitry.

The height of cylindrical shell sink 18 is slightly more than the length of capacitor 17. In this embodiment, when the lamp is operated at a driving frequency of 100 kHz, the length of sink 18 is typically about 25 mm. In this embodiment of the present invention, the outer diameter of the sink 18 is typically about 12 mm, and its wall thickness is typically about 1.0 mm.

The bottom of heat sink 18 is welded to the bottom of a cup 19 formed of copper that has good thermal contact with Edison socket cup 15. The outer diameter of cup 19 is typically about 24.5 mm; its height is typically about 7 mm, and the thickness of its wall is typically about 1.0 mm. Plastic enclosure 14 is screwed into the top part of the threads in Edison socket 15 thereby securing them to one another.

Heat sink 18 absorbs heat from capacitor 17 and transfers it to copper cup 19 which, in turn, transfers such heat to Edison socket cup 15. Socket cup 15 is screwed into a socket in the lamp holding fixture during use that is in good thermal contact with the rest of the fixture where the heat is eventually dissipated.

Figure 4:
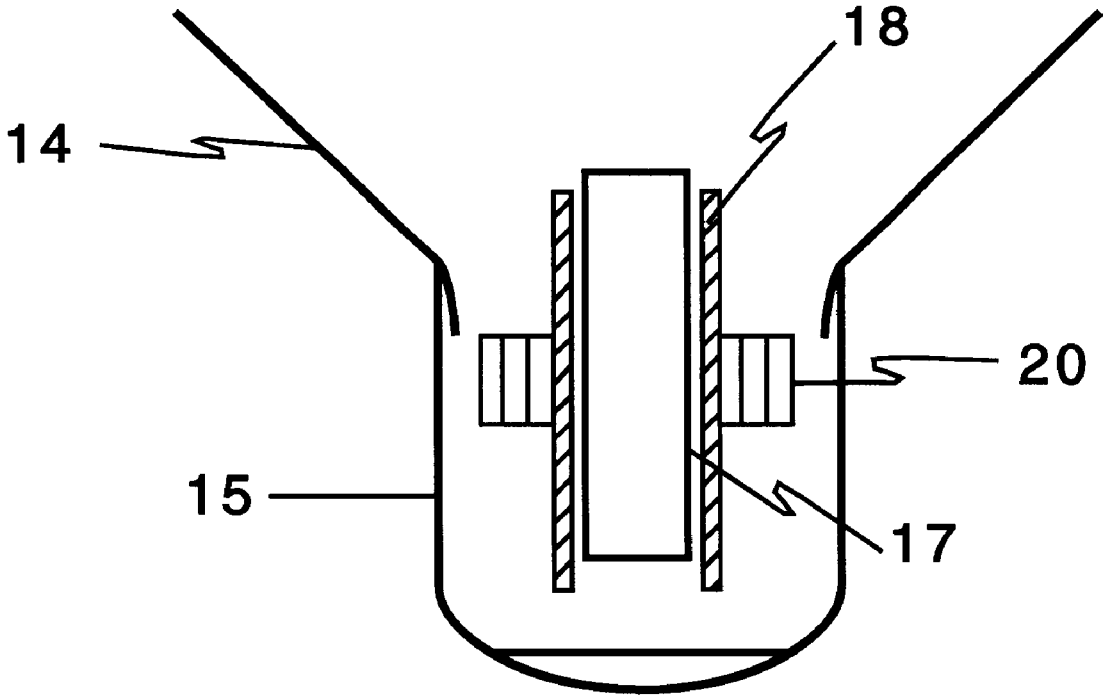
FIG. 4 is the schematic cross-section view of an alternative cooling structure for a driver circuit.

A further embodiment of the present invention is shown in cross section view in FIG. 4. Heat sink 18 is a copper cylindrical shell of the same size as that in the embodiment of FIG. 3. The heat absorbed by sink 18 is dissipated by cooling radiator 20 with a central opening that has many fins and is welded at that opening to the outer side surface of heat sink 18. In this arrangement, the heat from the capacitor 17 absorbed by the radiator 20 is transferred to Edison socket cup 15 via convection or conduction, or both.

Note that the liner 13 does not have any direct mechanical contact with heat sink 18 to thereby prevent conductive heat transfer from liner 13 to sink 18 and to so keep electrolytic capacitor 17 at temperature below 120° C. If liner 13 was instead mechanically connected to heat sink 18, the heat from ferrite material core 5 would be transmitted to capacitor 17 via plate 12 and liner 13, and so increase the capacitor temperature to values higher than 120° C.

The above described lamps operate as follows. Bulbous envelope 1, or bulb 1, is filled with an inert gas (argon, 1 torr). Mercury vapor pressure in this envelope is controlled by the temperature of the mercury drop in cold spot 7 and is typically around 5–6 mtorr. Standard commercial power line voltage at a frequency of 50–60 Hz with a magnitude of around 120 Volts rms is applied to the driver electronic circuitry assembled and interconnected on and in PC board 16. A much higher frequency (about 100 kHz) and magnitude voltage is generated by the driver circuitry from the power line voltage and applied to induction coil 4 via an impedance matching network.

When the coil high frequency voltage reaches magnitudes of 200–300 V, a capacitive discharge is ignited in bulb 1 along the cavity walls. Further increases in the coil voltage magnitude leads to a transition from a capacitive discharge to an inductively coupled discharge (lamp starting). The transition occurs when the coil voltage exceeds a "transition" value, $V_{tr}$, in this range. This transition is accompanied with a sharp decrease of the lamp reflected power, a drop of the coil voltage and current, and with a very large increase in the lamp visible light output.

The magnitude of $V_{tr}$ depends on the lamp envelope and cavity sizes, the gas and vapor pressures therein, and the number of turns in induction coil 4. In the preferred embodiments, the transition voltage, in a lamp operated at 100 kHz, was around 1000 V, and the transition coil current was around 5 A. The coil voltage and current that maintain the inductive discharge, $V_m$ and $I_m$, vary with lamp power and the mercury vapor pressure. After the lamp was operated at a power of about 25 W for 2 hrs, the mercury pressure stabilized and the coil maintaining voltage and current were 350 V and 1.8 A, respectively.

Figure 5:
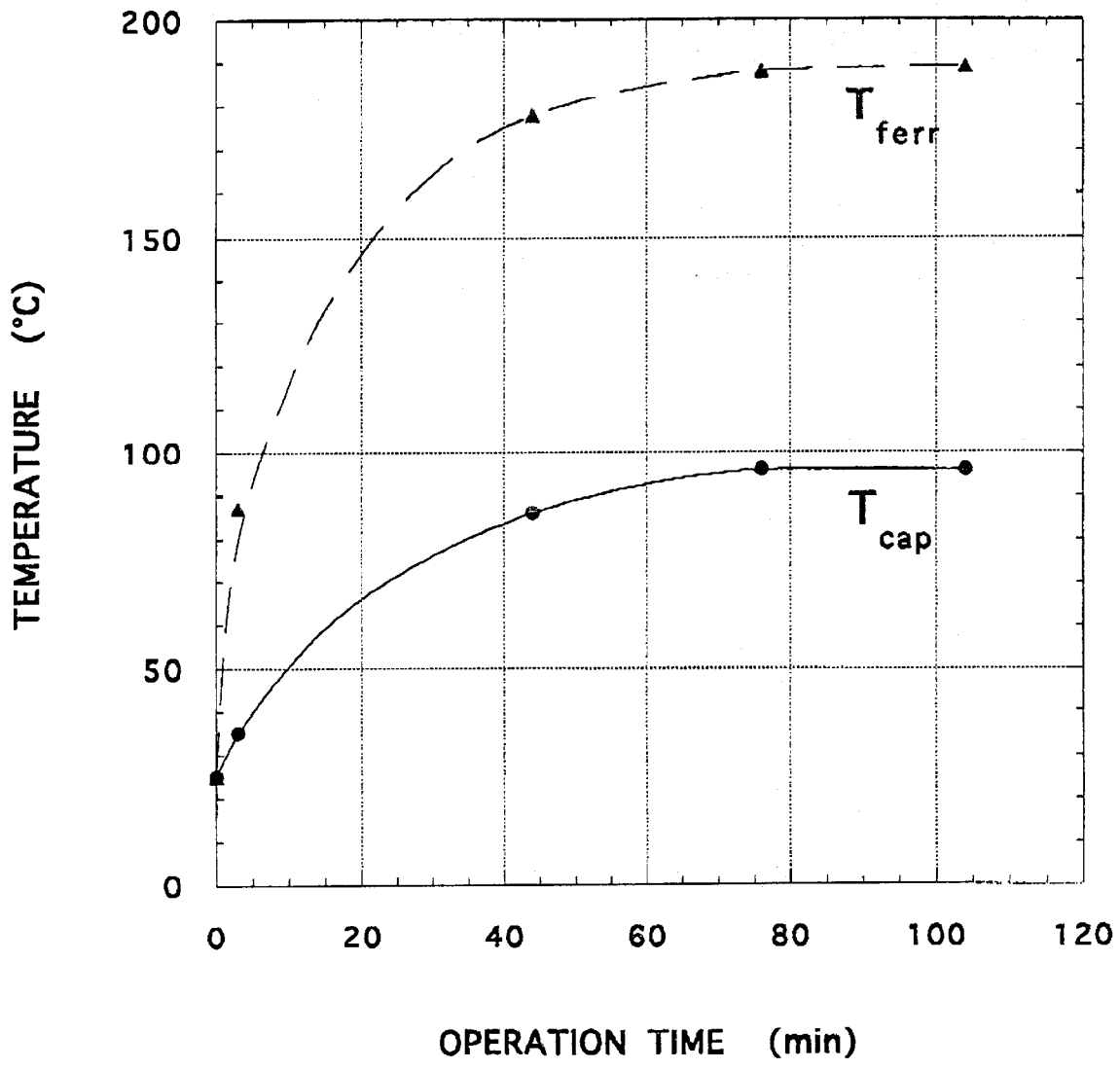
FIG. 5 is a graph showing a plot of run-up temperatures of a portion of a lamp during operation.

About 80% of the total lamp power of 25 W, $P_{lamp}$, is absorbed by the inductive plasma, represented as $P_{pl}$, and about 2 W is dissipated in the driver circuitry, $P_{drv}$. About 2–3 W of the lamp power is dissipated in induction coil 4 and in the ferrite material core 5, $P_{coil}$. This power dissipation together with the heat from the plasma via the cavity walls, causes heating of coil 4 and of ferrite material core 5. Thus, $P_{lamp}=P_{drv}+P_{coil}+P_{pl}=P_{drv}+P_{bulb}$. The cooling structures described in FIGS. 1–4 provide satisfactory thermal management of the lamps. This result is illustrated in FIG. 5 where temperatures of ferrite material core 5 and capacitor 17 of the lamp according to the embodiment of FIG. 3 are plotted shown as functions of the lamp operating time. It is seen that after operating for 2 hrs, the lamp, operated at 25 W and at a frequency of 100 kHz, has a ferrite core temperature of 186° C., and a capacitor temperature of about 100° C.

Figure 6:
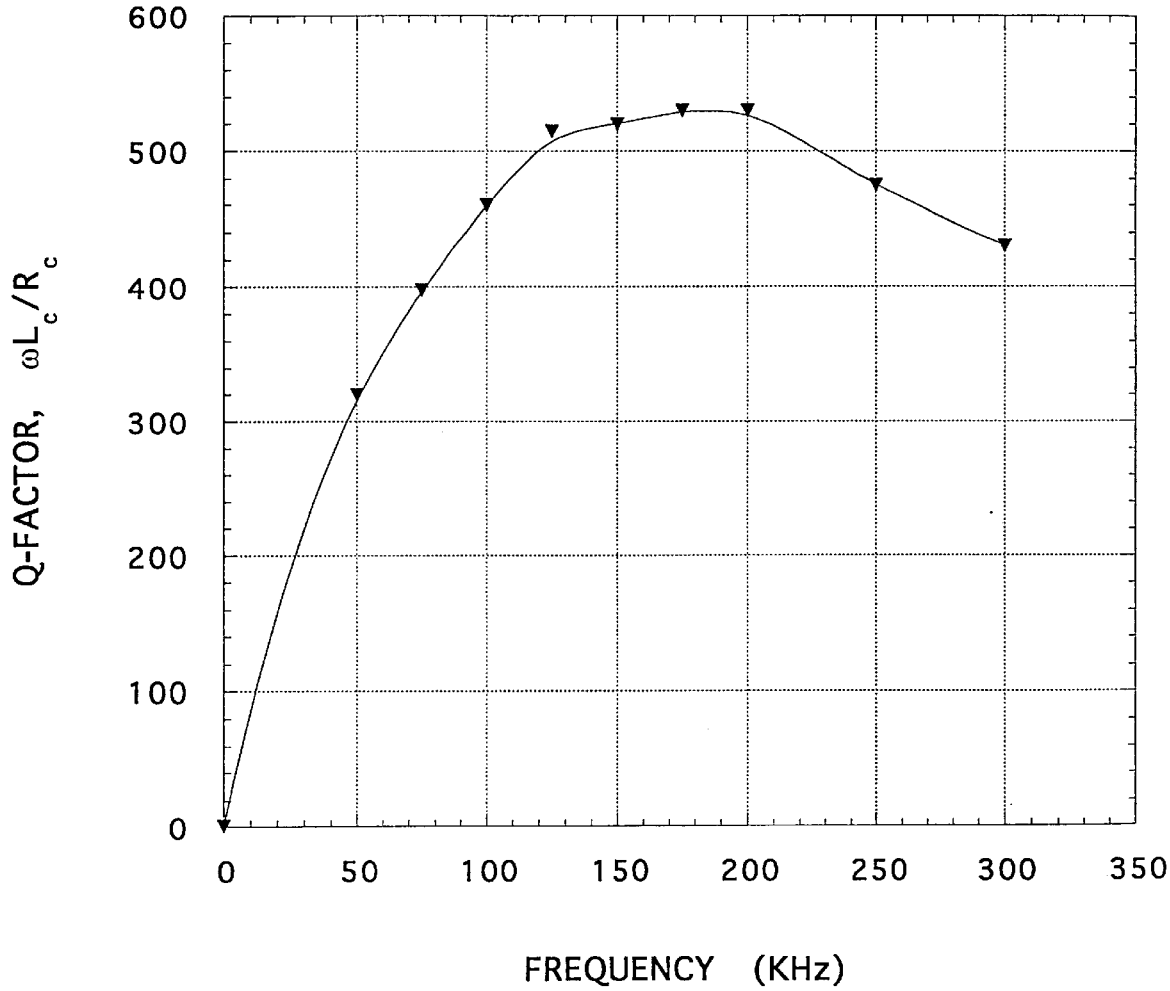
FIG. 6 is a graph showing a plot of the induction coil quality factor in a lamp as a function of the driving frequency.

The bulb power efficiency, $\eta=P_{pl}/(P_{pl}+P_{coil})=P_{pl}/P_{bulb}$, of the lamp operated at 100 kHz and at power of 25 W is 0.9. Such a high power efficiency was achieved due to the high Q-factor achieved for the assembly that comprises coil 4, ferrite material core 5, and the associated copper cooling structure. The dependence of the coil Q-factor on the driving frequency is given in the plot of FIG. 6. It is seen that the Q-factor reaches a maximum (540) at a frequency of about 175 kHz. But even at f=100 kHz, the Q-factor is still high and has there a value of about 460.

High lamp power efficiency results in high luminous efficacy for the lamp. The maximum lamp efficacy at the lamp peak light output (about 6 mtorr mercury vapor pressure), is 65 lumens per watt (LPW). After the lamp operates for 2 hrs at a power of 25 W, and the mercury pressure and lamp light output are stabilized, the lamp efficacy dropped to 60 LPW with the total stable light output of 1500 lumens.

Although the present invention has been described with reference to preferred embodiments, workers skilled in the art will recognize that changes may be made in form and detail without departing from the spirit and scope of the invention.

What is claimed is:

1. An electrodeless compact flourescent lamp for use in a lighting fixture, the lamp comprising:

a bulbous transparent envelope with a reentrant cavity provided in this envelope;

an inert gas and vaporizable metal provided in the envelope;

a phosphor coating on the inner surface of walls of the envelope;

an enclosure secured between the envelope and a lamp holder engagement structure;

induction coil positioned in the reentrant cavity, the coil for forming a plasma in the envelope to produce ultraviolet radiation to excite the phosphor coating, the phosphor coating generating visible light under such excitation;

a magnetic field manipulation structure of a magnetically permeable material positioned adjacent the induction coil and having a cross section along a plane parallel to that of the shunting surface that has a toroidal shape to fit within the induction coil with an extended disk-shaped base so as to be positioned between the induction coil and the primary cooling structure, the disk-shaped base having at least in part a shunting surface ending at a shunting surface periphery, said magnetic field manipulation structure concentrating and orienting a magnetic field; and a primary cooling structure of a thermally and electrically conductive material having a plate portion, and having a tube portion positioned adjacent to the magnetic field manipulation structure to be separated thereby from the induction coil, the plate portion extending so as to be substantially within the shunting surface periphery.

2. The lamp of claim 1 wherein the magnetic field manipulation structure is formed of at least one ferrite material.

* * * * *